United States Patent [19]

VanHorn et al.

[11] 4,447,865

[45] May 8, 1984

[54] REFLECTOR LAMP

[75] Inventors: David D. VanHorn, East Cleveland; John M. Putz, Twinsburg; Alfred J. Henderson, Jr., Shaker Hts., all of Ohio

[73] Assignee: General Electric Company, Schenectady, N.Y.

[21] Appl. No.: 377,754

[22] Filed: May 13, 1982

[51] Int. Cl.[3] ..... F21V 7/00

[52] U.S. Cl. ..... 362/305; 362/297; 362/304; 362/346; 362/348; 362/350; 362/375

[58] Field of Search ..... 362/297, 304, 305, 346, 362/348, 350, 375

[56] References Cited

U.S. PATENT DOCUMENTS 1,880,399 10/1932 Benjamin ..... 362/304

2,340,515 2/1944 Dietrich ..... 362/304

*Primary Examiner*—Stephen J. Lechert, Jr.

*Attorney, Agent, or Firm*—John P. McMahon; Philip L. Schlamp; Fred Jacob

[57] ABSTRACT

A reflector lamp comprising a concave reflector having a parabolic rear section, a spherical intermediate section, and a faceted parabolic front section, each section having substantially the same common focal point, and a finite light source located at the substantially common focal point. The reflector sections are dimensioned so that substantially all light rays from the finite light source which are reflected by the spherical intermediate section become re-reflected by the faceted parabolic front section. Additionally the light rays, reflected by the facets, include components thereof which are circumferential about a lamp axis and thereby provide a beam pattern which is substantially circumferentially uniform about the lamp axis.

11 Claims, 3 Drawing Figures

11
25
23
22
24
27
18
42
12
13
16
17
27'
21
14
15
19
43
20

11
32
31
12
15
27''
27'
2
2
23
23'
23''
13
16
14
18
31
32

REFLECTOR LAMP

CROSS-REFERENCE TO RELATED APPLICATIONS

Ser. No. 349,334, filed Feb. 16, 1982 which is a continuation-in-part of copending application Ser. No. 218,932 filed Dec. 22, 1980 and now abandoned.

Ser. No. 352,741, filed Feb. 26, 1982 which is a continuation-in-part of copending application Ser. No. 165,610, filed July 3, 1980, and now abandoned.

BACKGROUND OF THE INVENTION

The present invention is in the field of optical reflectors and more particularly in the field of reflector lamps.

One general type of reflector lamp comprises a concave reflector having a parabolic contour with respect to a focal point, so as to reflect frontwardly and along the lamp axis light emitted by a light source located at and near the focal point. The cross section of the reflector, perpendicular to the lamp axis, usually is circular with the diameter thereof varying with the distance from the focal point. Additionally, a cone of light rays, originating from the light source, pass, unreflected, through the front of the reflector; the angle of this cone of rays being determined and defined by the front rim of the reflector. The more widely divergent light rays of the cone of rays, that is, the rays passing relatively nearer to the rim of the reflector, have such a large sideways component of direction so as to fall outside of the desired light pattern and therefore are wasted.

The wasted, divergent light can be reduced, and the optical efficiency improved, by making the reflector deeper, that is longer, so that relatively more of the light is reflected in the desired direction and the cone of nonreflected light is narrowed. However, there are practical limitations on increasing the depth of the reflector, such as cost, weight and awkwardness of use. Also, with a given maximum diameter as the reflector is made deeper, the focal point moves closer to the rear surface, which complicates positioning of the light source and if the light source is a filament there is accelerated blackening of the nearby rear area of the reflector due to evaporation of the filament material (usually tungsten). This accelerated blackening can be alleviated by providing a concave recess at the rear portion of the reflector but has the drawback of reducing optical efficiency.

As disclosed in the cross-referenced application Ser. Nos. 349,334 and 352,741, reflectors have been designed which substantially eliminate the wasted, divergent light and accelerated blackening of the reflector rear area described heretofore. However, such reflectors produce an asymmetrical beam pattern due to the long, slender configuration of the lamp filament. That is, the beam pattern is not circumferentially uniform about the lamp axis. One means of providing a more symmetrical beam pattern is to place a diffusing lens over the lamp. Optical correction of the beam pattern through use of a diffusing lens, however, has several disadvantages including large variations in lens thickness resulting in a more costly and difficult lens to manufacture. Additionally a diffusion lens spreads the beam pattern in an undesirable radial direction. That is, the lens broadens the beam pattern creating undesirable and wasted divergent light which is counter to the advancement over the prior art as disclosed in the cross-referenced applications.

SUMMARY OF THE INVENTION

Objects of the invention are to provide a reflector, and reflector lamp, having an improved optical efficiency and a beam pattern substantially circumferentially uniform about a lamp axis which permits a lamp design having lower power consumption in a reasonably compact lamp.

These and other objects of the present invention are achieved by providing a lamp unit comprising a reflector and a finite light source wherein the reflector has a faceted, substantially parabolic front section, a substantially spherical intermediate section, and a substantially parabolic rear section. Each of the reflector sections has substantially the same common focal point and is dimensioned so that substantially all light rays, which are reflected by the spherical intermediate section from a finite light source positioned substantially at the common focal point, are re-reflected by the faceted, parabolic front section.

DESCRIPTION OF THE PREFERRED EMBODIMENT

Figure 1:
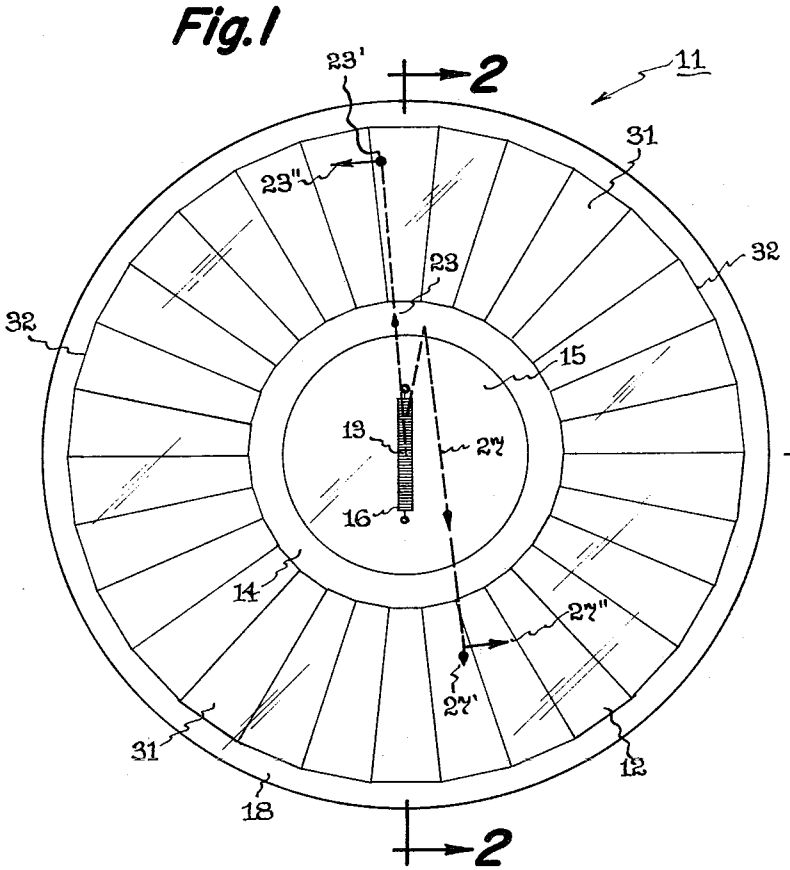
FIG. 1 is a front view of a reflector lamp in accordance with a preferred embodiment of the invention.

A preferred embodiment of the invention, as shown in the drawing, comprises a reflector lamp having a concave reflector 11 shaped to have a faceted front reflector section 12 which has a substantially parabolic contour with respect to a focal point 13, an intermediate reflector section 14 which has a substantially spherical contour with respect to the focal point 13, and a rear reflector section 15 which has a substantially parabolic contour with respect to the focal point 13. The cross section of the reflector 11 in planes perpendicular to the principal optical axis thereof is substantially circular, as shown in FIG. 1. Thus, each of the three reflector sections is defined by a surface of revolution of a parabolic or circular curve.

A finite light source, that is, a light source that is neither infinite nor infinitesimal in size such as a filament 16, is substantially centered at the focal point 13 and generally is either substantially perpendicular to or in the plane of the parabolic front section latus rectum. The latus rectum is defined as the breadth of the front parabolic reflector curve at the focal point 13 and is represented by line 17 in FIG. 2. That is, the light source 16 is generally located in or perpendicular to the plane 17 of mutual truncation at the joinder of the front section 12 and intermediate section 14, as shown in the drawing.

Alternative light sources can be employed in place of the filament 16, such as a halogen regenerative-cycle incandescent lamp or an arc discharge lamp. A lens means such as a shaped lens or cover plate 18 may be placed or sealed over the front opening of the reflector 11, to protect the reflecting surface and keep it clean, and/or to modify the light pattern, and is required if the light source is a bare filament 16 in the reflector. The reflector 11 can be made of molded glass, its inner surface being coated with aluminum or silver to provide a reflective surface. Preferably the filament 16 is made of tungsten and is mounted on a pair of lead-in wires 19 and 20 of suitable material such as nickel.

Figure 2:
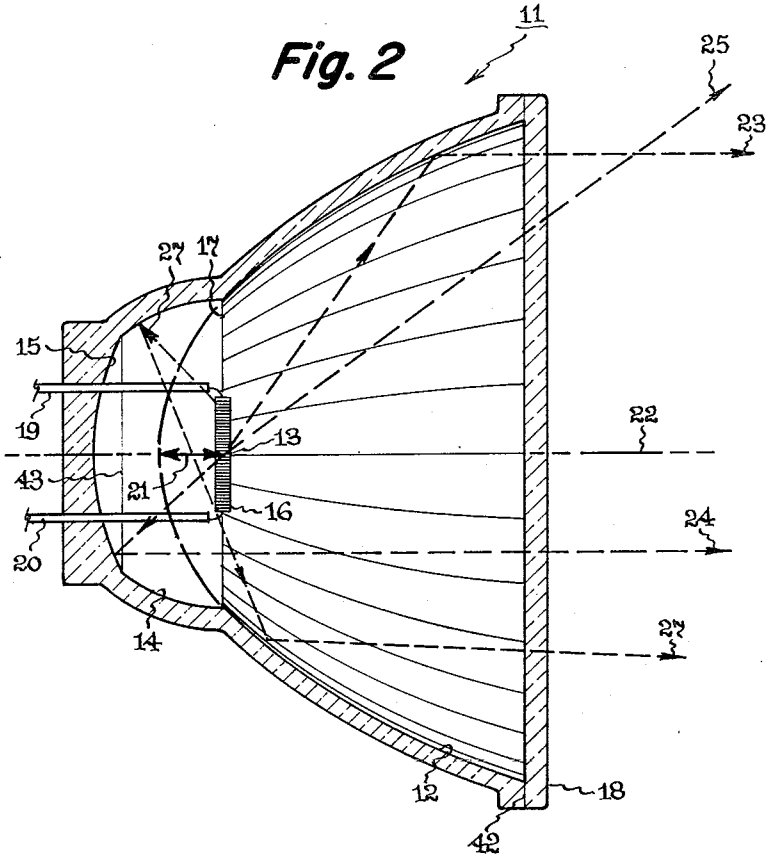
FIG. 2 is a cross section side view taken on the line 2—2 of FIG. 1.

Although in the preferred embodiment the focal points of the parabolic and spherical sections are substantially confocal, the focal point of the spherical intermediate section need not be located at substantially the same spatial position as the focal points of the parabolic sections while remaining within the scope of the invention. More specifically, the focal point of the spherical section can be located between the common focal points of the parabolic sections and a point spaced therefrom located at a distance not greater than the length between the focal point and vertex of the front section parabolic curve as measured along the lamp axis 22 and is represented in FIG. 2 as 21. In such an embodiment, the finite light source would be positioned substantially at the common focal points of the parabolic sections.

Similarly, although in the preferred embodiment the finite light source intersects the substantially confocal points of the parabolic and spherical sections and lies in a plane substantially perpendicular to or in the plane of the front parabolic section latus rectum, the finite light source can be located elsewhere while remaining within the scope of this invention. That is, the finite light source can lie in a plane substantially perpendicular or parallel to the front parabolic section latus rectum 17 and located spatially from the substantially confocal points of the parabolic and spherical sections at a distance not greater than the length between the focal point and vertex of the front parabolic curve as measured along the lamp axis 22 and as represented in FIG. 2 as 21.

Light rays which emanate from the light source 16 and which strike the faceted front reflector section 12, will be reflected in a generally frontward direction and circumferential direction about the lamp axis, as indicated by the light ray path 23. More specifically, and as shown in FIG. 1, light ray 23 has a component in a frontward direction, substantially parallel to the lamp axis 22 and represented by light ray 23′, and a component in a circumferential direction about the lamp axis 22 and represented by light ray 23″. The circumferential component 23″ can be viewed as tangential to a point on a circle with the lamp axis as the circle center and light ray 23′ intersecting the point.

Light rays emanating from the filament 16 and which strike the parabolic rear reflector section 15, will be reflected generally frontwardly and substantially parallel to the lamp axis 22 as indicated by the light ray path 24. A certain relatively small amount of light emanating from the light source 16 is not reflected by the reflector 11, and undesirably emerges through the front opening of the reflector in a divergent beam pattern, as indicated by the light ray path 25. The relative amount of this light depends on how far frontwardly the reflector extends from the focal point.

The spherical intermediate section 14 is dimensioned with respect to the front section 12 so that substantially all of the light emanating from the light source 16, other than at focal point 13, and which strikes the spherical intermediate section 14, will be reflected thereby in a direction so as to strike the faceted front section 12 and be re-reflected thereby in a generally frontwardly direction and circumferentially about the lamp unit axis 22. For example, as illustrated in FIG. 2, a light ray 27 emanating from the light source 16 strikes the intermediate spherical section 14 and is reflected back onto the faceted front reflector section 12 and is directed thereby frontwardly, that is, having a component in a direction substantially parallel to the lamp unit axis 22 as represented by light ray 27′. Additionally light ray 27 has a component in a circumferential direction about the lamp unit axis 22 and is represented by light ray 27″.

The combined substantially frontward and circumferential directions, as heretofore disclosed, are due to the faceted surfaces of the front section 12 of lamp unit 11. The facets 31 in a preferred embodiment, cover substantially the entire front section and as viewed in planes perpendicular to the lamp axis 22 and as shown in FIG. 1, have ends 32 which are substantially straight. Each facet 31 can be further viewed as comprising individual subsections wherein each subsection has been rotated about an axis. Each axis is defined as a tangent to the surface of revolution of the front section parabolic curve which passes through a point on the surface of the front section 12 and which lies in a plane containing the point and the lamp axis 22. By having each faceted subsection rotated and positioned about a precisely located axis, the facets provide not only a substantially frontward beam which substantially eliminate all divergent, wasted light but also provide a beam pattern which is substantially circumferentially uniform about the lamp axis and thereby substantially eliminate the non-uniform beam pattern about the lamp axis provided by the prior art.

It is to be noted that although for purposes of description, a faceted surface is provided exclusively on the front parabolic section that both the front and rear parabolic sections can be faceted with subsections in the front section positioned about axes as previously defined and with subsections in the rear section rotated about axes wherein each axis is defined as a tangent to the surface of revolution of the rear section parabolic curve which passes through a point on the surface of the rear section 15 and which lies in a plane containing both the point and lamp axis 22.

Figure 3:
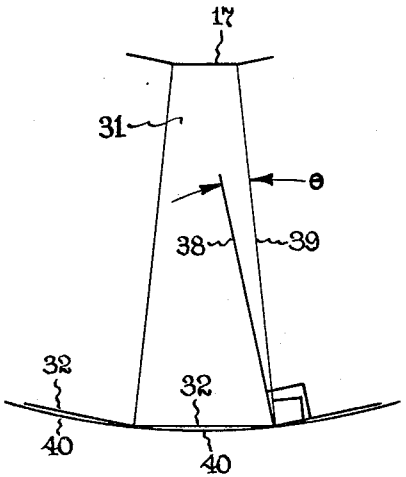
FIG. 3 is a detailed fragmentary front view of a reflector lamp illustrating a typical facet as shown in FIG. 1.

Furthermore, and as shown in FIG. 3, each faceted surface has an angular difference $\Theta$ between a normal 38 thereto and a normal 39 to a portion of the surface of revolution of the parabolic curve 40 circumscribing the facet 31, as viewed in planes perpendicular to the lamp axis 22, of no greater than approximately 15°. Such a limited angular difference ensures that the light rays reflected by the facets are substantially in a frontward direction and in a circumferential direction about the lamp axis 22 and do not contain substantially divergent light.

It is also to be noted that light rays reflected by the intermediate spherical section 14 and which emanate from the light source 16, at focal point 13, are not reflected in a direction so as to strike the parabolic front section 12. In more general terms, as is well known in the art and as disclosed in the cross-referenced applications (Ser. Nos. 349,334 and 352,741), incorporated herein by reference thereto, any portion of the light source whose reflected image coincides with itself or any other portion of the light source will provide no useful light output inasmuch as the reflected image cannot travel through the actual light source.

A preferred method of designing the reflector, is to first design the front section 12 having facets 31, as previously disclosed, and then design the contour of the spherical section 14. Next, a line is drawn from the rim 42, and through the focal point 13, to the contour line of the intermediate section 14; this point of intersection establishes the joinder plane 43 at the rear of the section 14 where it joins the rear section 15.

In scientific optical terminology, and as partially described previously, the breadth of the parabolic reflector curve at the focal point 13 is the latus rectum 17 and the vertex is the point on the rear surface directly behind the focal point 13 and on the lamp axis 22. That is, the vertex of the front parabolic section 12 is the point thereon that would be directly behind the focal point 13 if the parabolic curvature were to be continued behind the focal point 13. Thus the focal point 13 is relatively close to the vertex of the front parabolic curve and is substantially farther from the vertex of the rear parabolic curve 15. The diameter of the spherical intermediate section 14 is essentially equal to the length of the latus rectum 17 of the front parabolic curve 12.

The light beam pattern as it reaches the front of the front section 12 can be further modified by lenses and/or diffusers to achieve a desired light distribution at a specified distance from the lamp such as in a spotlamp or a floodlamp.

Additionally the space defined and surrounded by the spherical intermediate section 14 provides a recess for accommodating the light source 16, and spaces the reflecting surfaces at the back part of the reflector sufficiently far from the filament 16 to minimize blackening thereof by evaporated filament material, and accomplishes this while retaining an optical efficiency substantially as good as if the entire reflector had a single parabolic curvature.

Since the invention provides a reflector construction in which substantially all of the light reflected by the intermediate section is re-reflected in the desired frontward and circumferential directions by the parabolic front section, and is not "lost" by passing beyond the front face in a divergent pattern, the improved optical efficiency permits construction of a lamp requiring lower watts of power for a given amount of useful light.

Thus, while a preferred embodiment of the invention has been shown and described, various other embodiments and modifications thereof will become apparent to persons skilled in the art, and will fall within the scope of the invention as defined in the following claims.

We claim:

1. A lamp comprising a substantially concave reflector having faceted surfaces longitudinally extending along a major portion of a front section of said reflector, said faceted surfaces comprising subsections each of which is rotated about an axis predeterminedly located relative to the longitudinal axis of said lamp, said front section being substantially defined by a surface of revolution of a first parabolic curve whose focal point is relatively close to the vertex thereof with the surface terminating essentially at the latus rectum thereof, an intermediate section of substantially spherical configuration having a center substantially at the focal point of said front section and a diameter essentially the length of said latus rectum, a rear section substantially defined by a surface of revolution of a second parabolic curve which terminates at the circular junction with said spherical intermediate section, having a focal point located substantially farther from the vertex of said second parabolic curve than said first parabolic curve with said two focal points being substantially coincident, and a finite light source positioned substantially at said substantially coincident focal points so that substantially all light rays from said light source which are reflected by said spherical intermediate section are re-reflected by said front section, wherein said light rays reflected by said facets include components thereof which are circumferential about the lamp axis and thereby provide a beam pattern which is substantially circumferentially uniform about said lamp axis.

2. A lamp as claimed in claim 1 wherein each predeterminedly located axis of each of subsection is defined as a tangent to said surface of revolution of said first parabolic curve which passes through a point on said surface of said front section and which lies in a plane containing said point and said lamp axis.

3. A lamp as claimed in claim 1 wherein said reflector has faceted surfaces on said front and rear sections which have been rotated about axes, each axis in said front section defined as a tangent to said surface of revolution of said first parabolic curve which passes through a point on said surface of said front section and which lies in a plane containing said point and said lamp axis and in said rear section defined as a tangent to said surface of revolution of said second parabolic curve which passes through a point on said surface of said rear section and which lies in a plane containing said point on said rear section and said lamp axis.

4. A lamp as claimed in claims 2 or 3 wherein each of said facets is circumscribed by a portion of one of said surfaces of revolution.

5. A lamp as claimed in claim 4 wherein each of said faceted surfaces and each of said portions have normals thereto, in planes perpendicular to said lamp axis, with an angular difference between said normals of no greater than approximately 15°.

6. A lamp as claimed in claim 5 wherein a lens means is attached to the remote edge of said front section.

7. A lamp as claimed in claim 5 wherein said finite light source lies substantially in the plane of said latus rectum and intersects said substantially coincident focal points.

8. A lamp as claimed in claim 5 wherein said finite light source lies substantially in a plane parallel to the plane of said latus rectum and is located spatially therefrom at a distance not greater than the length between said focal point and vertex of said first parabolic curve as measured along said lamp axis.

9. A lamp as claimed in claim 5 wherein said finite light source lies substantially in a plane perpendicular to the plane of said latus rectum and intersects said substantially coincident focal points.

10. A lamp as claimed in claim 5 wherein said finite light source lies substantially in a plane perpendicular to the plane of said latus rectum and is located spatially from said substantially coincident focal points at a distance not greater than the length between said focal point and vertex of said first parabolic curve as measured along said lamp axis.

11. A lamp as claimed in claim 5 wherein said center of said spherical section is located between said substantially coincident focal points of said parabolic sections and a point spaced therefrom located not greater than the length between said focal point and vertex of said first parabolic curve as measured along said lamp axis and further wherein said finite light source is positioned substantially at said substantially coincident focal points of said parabolic sections.

* * * * *